US006460966B1

(12) United States Patent
Hellekson et al.

(10) Patent No.: US 6,460,966 B1
(45) Date of Patent: Oct. 8, 2002

(54) THIN FILM MICROHEATERS FOR ASSEMBLY OF INKJET PRINTHEAD ASSEMBLIES

(75) Inventors: Ronald A. Hellekson, Eugene, OR (US); Alfred I-Tsung Pan, Sunnyvale, CA (US); Marshall Field, Corvallis, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/938,710

(22) Filed: Aug. 23, 2001

(51) Int. Cl.[7] ..... B41J 2/175
(52) U.S. Cl. ..... 347/20; 347/87
(58) Field of Search ..... 347/20, 62, 64, 347/86, 87

(56) References Cited

U.S. PATENT DOCUMENTS 5,659,345 A * 8/1997 Altendorf ..... 347/87
5,883,650 A * 3/1999 Figueredo et al. ..... 347/62
6,123,410 A * 9/2000 Beerling et al. ..... 347/42

* cited by examiner

*Primary Examiner*—Anh T. N. Vo

(57) ABSTRACT

A method and apparatus for assembling an inkjet printhead is disclosed. The apparatus comprises one or more microheater resistors and a material, which can be reflowed by use of the heat generated by the microheater, disposed proximate to the heater resistor. The microheater resistor comprises a heater resistor with an input port and an output port. A first electrical conductor, coupled to the input port of the heater resistor, receives a first voltage and a second electrical conductor, coupled to the output port of the heater resistor, receives a second voltage. A curing effect in the adhesive is produced by heat generated in the heater resistor when electrical current flows through the resistor in response to an application of a first voltage to the first electrical conductor and a second voltage to the second electrical conductor.

21 Claims, 7 Drawing Sheets

THIN FILM MICROHEATERS FOR ASSEMBLY OF INKJET PRINTHEAD ASSEMBLIES

FIELD OF THE INVENTION

The present invention relates to inkjet printing devices, and more particularly to the use of patterned thin film microheaters for assembly of inkjet printhead assemblies.

BACKGROUND OF THE INVENTION

Thermal inkjet (TIJ) technology is widely used in computer printers. Very generally, a TIJ includes a printhead typically comprising several tiny controllable inkjets, which are selectively activated to release a jet or spray of ink from an ink reservoir onto the print media (such as paper) in order to create an image or portion of an image. TIJ printers are described, for example, in the Hewlett-Packard Journal, Volume 36, Number 5, May, 1985, and Volume 39, Number 4, August, 1988.

Thermal inkjet print cartridges operate by rapidly heating a small volume of ink to cause the ink to vaporize and be ejected through one of a plurality of orifices so as to print a dot of ink on the print medium. Typically, the orifices are arranged in one or more linear arrays in a nozzle member. The properly sequenced ejection of ink from each orifice causes characters or other images to be printed upon the print medium as the printhead is moved relative to the print medium.

In one known design, the inkjet printhead generally includes ink channels to supply ink from an ink reservoir to each vaporization chamber proximate to an orifice, a metal orifice plate or nozzle member in which the orifices are formed in the required pattern, and a silicon substrate containing a series of thin film resistors, one resistor per vaporization chamber.

To print a single dot of ink, an electrical current from an external power supply is passed through a selected thin film resistor. The resistor is then heated, in turn superheating a thin layer of the adjacent ink within a vaporization chamber, causing explosive vaporization, and consequently, causing a droplet of ink to be ejected through an associated orifice onto the print medium.

An exemplary inkjet cartridge is described in U.S. Pat. No. 4,500,895, entitled "Disposable Inkjet Head", and is assigned to the present assignee.

Another inkjet printhead is described in U.S. Pat. No. 4,683,481, entitled "Thermal Ink Jet Common-Slotted Ink Feed Printhead", wherein ink is fed from an ink reservoir to the various vaporization chambers through an elongated hole formed in the substrate. The ink then flows to a manifold area, formed in a barrier layer between the substrate and a nozzle member, then into a plurality of ink channels, and finally into the various vaporization chambers. This design is known as a center feed design, whereby ink is fed to the vaporization chambers from a central location and then distributed outwardly into the vaporization chambers.

In TIJ pens it is necessary to connect the ink reservoir to the printhead. The size of this connection affects the design of the printer that the pens are used in. An ideal reservoir-to-printhead coupler, from a print design point of view, would be no longer than the TIJ head is long, and would be high or tall enough to allow the drive and pinch wheels to get as close to the printhead as possible. Any increase in the size of this coupler will compromise the paper handling ability, which may affect the print quality, and increase the size of the printer.

In one exemplary spring bag pen design, the pen frame of a first molded material is lined with a second molded material, such as polyethylene, on the inside to produce a surface suitable for staking the films of the spring bag. The first molded material from which the frame is made could be, for example, an engineering plastic, and provides the necessary structure for the pen which could not be accomplished with the second molded material. In this design, the fluid connection of the first and second molded materials needs to designed in such a way as to provide a space-efficient, leak-resistant connection.

Conventional methods of connecting plastic materials, including those used in TIJ pens, include the use of glue, seals, such as gaskets or 0-rings, or mechanical press fits. In these cases two or more separate parts are fabricated and assembled together to form a single unit. Each part must be designed and sized with respect to its needs in manufacturing, structural integrity, and with the tolerance of the mating part in mind. Such joints as these take up space, and their reliability can be affected by the part tolerances, surface finishes, and the assembly operation and the material properties of the adhesive.

Commonly assigned application Ser. No. 07/853,372 describes a leak-resistant joint between the first and second molded materials, wherein the first and second molded materials have different shrink rates. As the first material cools from a molten state, the second molded material is molded about a standpipe formed of the first molded material thereby creating a tight joint between the two molded materials. In each of these exemplary devices, the TIJ printheads are assembled using polymer substrates and thermoset adhesives which are cured by heating the entire printhead/pen assembly. This procedure results in large deformations due to coefficient of thermal expansion mismatches and substrate processing defects. In addition, this heating of the entire assembly frequently effects performance of other parts or limits the kinds of assembly sequences and automation strategies that can be pursued. Furthermore, some materials which might be beneficial can not be used in the assemblies since the entire assembly is subjected to this curing process.

SUMMARY OF THE INVENTION

The invention makes use of patterned thin film resistors (microheaters) for assembly of the inkjet printhead assemblies wherein once activated, the microheaters cure the interfaces between different parts of the assembly thereby alleviating the need for curing the entire printhead assembly.

According to one embodiment of the invention, an apparatus for assembling an inkjet printhead is disclosed. Other embodiments discussed hereinafter include, but are not limited to: reflowing thermoplastic or thermoset materials such as thermoset polymers, all of which are referred to hereinafter as temperature curable adhesive. Still other embodiments contemplate reflowing a solder or brazing material. The heating apparatus comprises a microheater and a temperature curable adhesive disposed proximate to the heater resistor.

The microheater comprises a heater resistor with electrical contacts referred to as an input port and an output port. A first electrical conductor, coupled to the input port of the heater resistor, receives a first voltage and a second electrical conductor, coupled to the output port of the heater resistor, receives a second voltage. A curing effect in the adhesive is produced by heat generated by current flow caused by the application of a first voltage to the first electrical conductor and a second voltage to the second electrical conductor. A voltage differential across the input and output ports causes a current to flow through the heater resistor, elevating its temperature.

According to another embodiment of the invention, an inkjet printer cartridge is disclosed. The inkjet cartridge comprises a printhead comprising a top side and a bottom side, the bottom side having a microheater, and a printhead attachment. The microheater comprises a heater resistor comprising an input port and an output port. A first electrical conductor, coupled to the input port of the heater resistor, receives a first voltage and a second electrical conductor, coupled to the output port of the heater resistor, receives a second voltage. The printhead attachment is disposed below the bottom side of the printhead, wherein the printhead attachment is affixed to the printhead by an application of a first voltage to the first electrical conductor and a second voltage to the second electrical conductor.

According to another embodiment of the invention, a method for assembling an inkjet printhead assembly is disclosed. A heater resistor is patterned onto a bottom surface of a printhead. A printhead attachment is aligned in a desired position wherein a surface of the printhead attachment is in contact with the heater resistor. A voltage drop is applied across a heater resistor which produces an electrical current in the heater resistor. A temperature increase in the heater resistor and an area proximate to the heater resistor is generated in response to the production of an electrical current thereby causing the printhead and printhead attachment to attach to the heater resistor.

According to another embodiment of the invention, a method for attaching pieces of a manifold using localized heating is disclosed. A thin film resistor is patterned onto a surface of a first half of a manifold with a first fluid passage. A second half of the manifold is aligned with a second fluid passage so as to provide a third fluid passage through the manifold, wherein a surface of the second half of the manifold is in contact with the thin film resistor. A voltage drop is applied across the thin film resistor to produce an electrical current in the thin film resistor. A temperature increase in the thin film resistor and an area proximate to the thin film resistor is generated in response to the production of the electrical current. At least portions of the first half and the second half of the manifold proximate to the thin film resistor are cured by the temperature increase thereby attaching and sealing the first half and the second half of the manifold to the thin film resistor.

BRIEF DESCRIPTION OF THE DRAWINGS

These and other features and advantages of the invention will become more apparent from the following detailed description of an exemplary embodiment thereof, as illustrated in the accompanying drawings, in which.

DETAILED DESCRIPTION

Figure 1A:
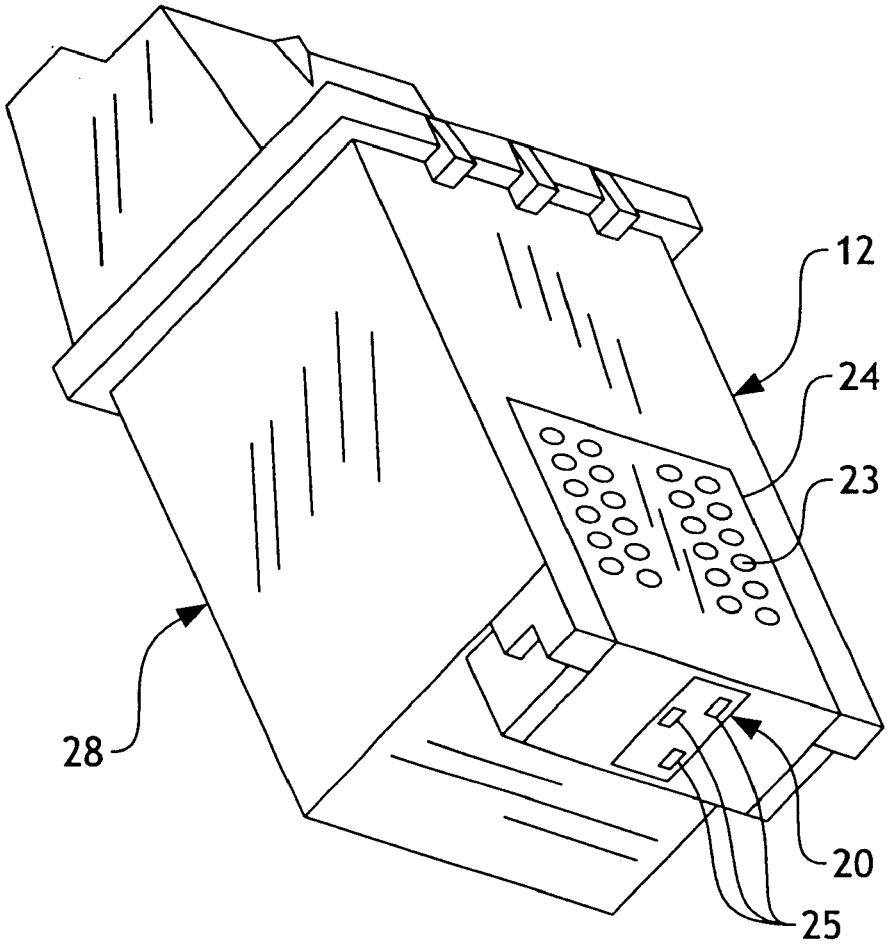
FIGS. 1(*a*)–1(*b*) illustrate an exemplary thermal inkjet pen assembly.
Figure 1B:
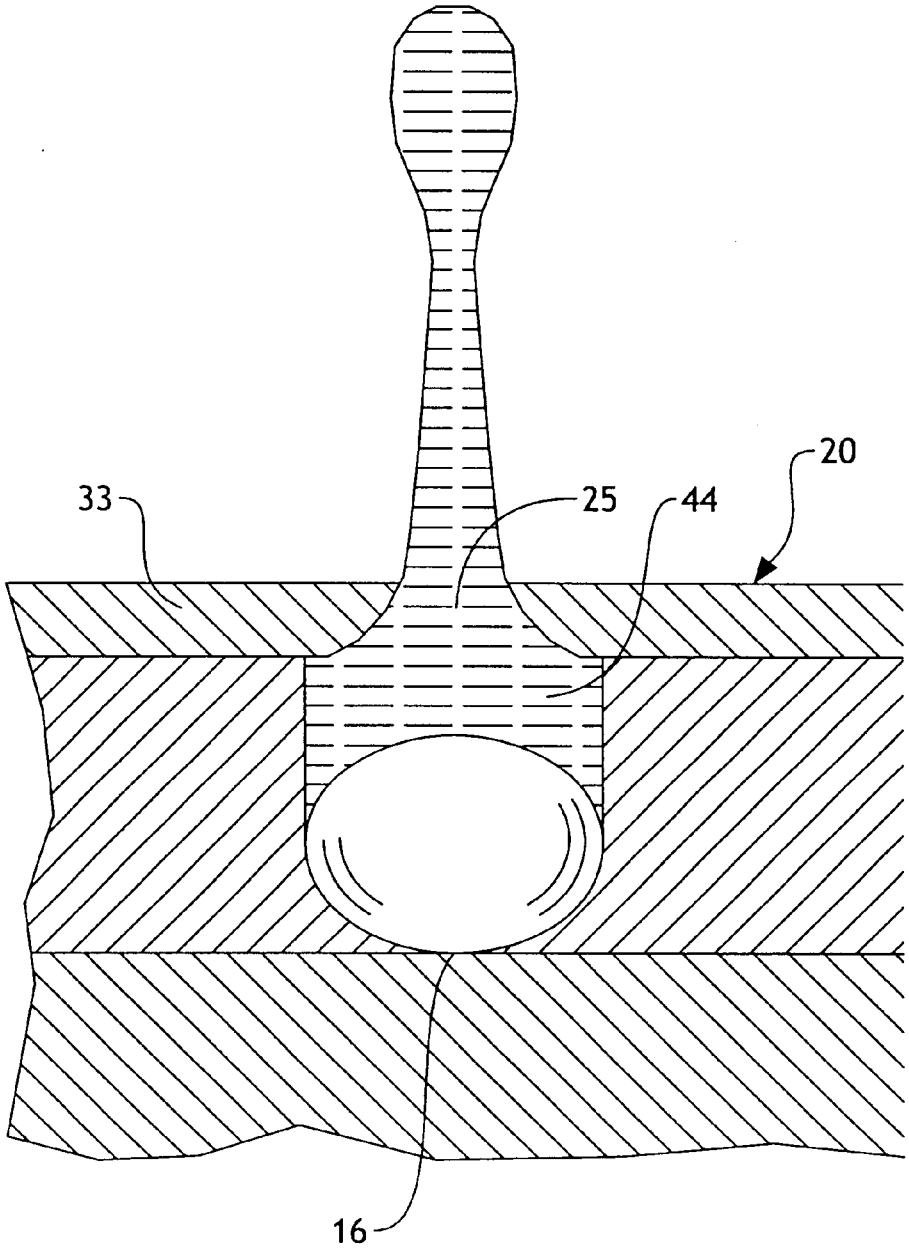

An exemplary thermal inkjet pen assembly is illustrated in FIGS. 1(*a*)–1(*b*). The pen includes a pen body 12 defining a reservoir 28. The reservoir 28 is configured to hold a quantity of ink. A printhead 20 with an orifice plate 33 is fit into the bottom of the pen body 12 and controlled for ejection of ink droplets. The printhead includes minute nozzles 25 through which ink is expelled in a controlled pattern during printing.

Each nozzle 25 is in fluid communication with a firing chamber 44 defined in the printhead 20 adjacent to the nozzle. Each firing chamber 44 is constructed adjacent to a part of the printhead substructure 16 that includes an electrical energy-to-thermal energy transducer, preferably a resistor component 30, not shown in FIG. 1(*a*) or 1(*b*). The resistor 30 is selectively driven (heated) with sufficient electrical current to instantly vaporize some of the ink in chamber 44, thereby forcing an ink droplet through the nozzle 25.

Conductive drive lines for each resistor component 30 are carried upon a flexible circuit 24 mounted to the exterior of the pen body 12. Circuit contact pads 23 at the ends of the resistor drive lines engage similar pads carried on a matching circuit attached to the printer carriage (not shown). A signal for firing the resistors is generated by a microprocessor and associated drivers that apply the signals to the drive lines.

Figure 2:
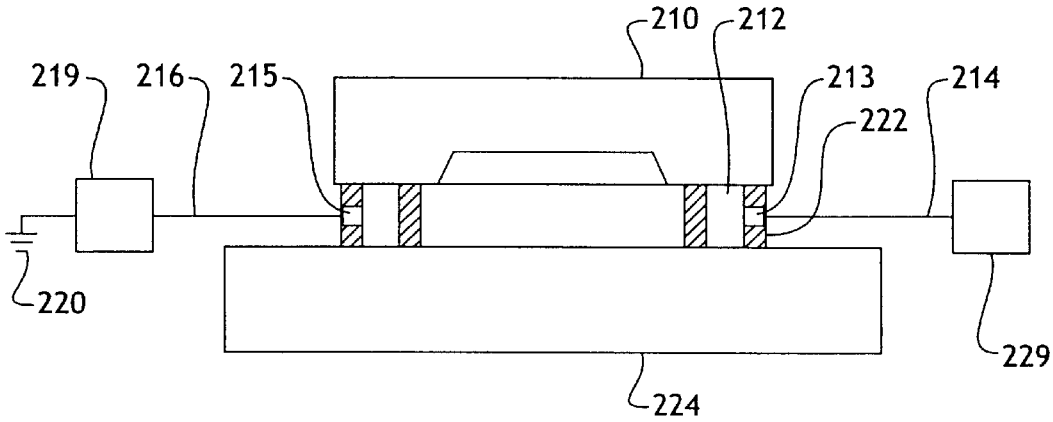
FIG. 2 illustrates using a thin film resistor to attach a printhead to a printhead assembly according to one embodiment of the invention.

According to one embodiment of the invention, thin film resistors (microheaters) can be used to provide localized heating, to attach and seal a silicon printhead to a substrate of a printhead attachment or assembly as illustrated in FIG. 2. In this embodiment, the printhead 210 is initially manufactured in a known manner, for example as described in U.S. Pat. Nos. 4,862,197 and 5,883,650. A thin film resistor or heater resistor 212 is then patterned onto the bottom side of the printhead 210.

Resistive heaters can be fabricated in a number of ways and on a number of substrate materials. For the resistive heater to work correctly, the resistive heater material is usually electrically insulated from the substrate or the substrate material is nonconducting. Therefore if the substrate material is nonconducting the resistive heater material can be fabricated onto the substrate or substrate material by means of selective plating (either additive or subtractive), vacuum deposition of the resistive material or by other means of deposition. If the substrate material is a moldable, and non-conductive material, the thin resistive heating element may be molded into the substrate material itself. If the substrate material is conductive, then an insulating layer must be installed between the substrate and the resistive heater elements. The insulating layer can be installed by plating means or deposition. Once the insulating layer is available the resistive heater can be fabricated by selective plating (additive or subtractive), vacuum deposition of the resistive material or by other means of deposition. The specific dimensions of the resistive element can be defined in many ways. Among these are patterning by means of photolithographic processes, laser removal of unwanted material, or selective etching of unwanted material.

The thin film resistor 212 has an input port 213 and an output port 215. A first electrical conductor 214 is coupled to the input port 213 of the thin film resistor 212 and receives a first voltage from a first voltage source 229. A second electrical conductor 216 is coupled to the output port 215 of the thin film resistor 212 and receives a second voltage. The second voltage can comprise a circuit ground 220. A switching device 219 such as one or more bipolar or field effect transistors or functional equivalents thereto, can be coupled between the circuit ground 220 and the second electrical conductor 216, wherein when the switching device 219 is enabled an electrical current is produced in the thin film resistor 212. In addition, the thin film resistor 212 can be electrically insulated from areas of the substrate by means of a thin film insulator 222, such as silicon oxide or other dielectric materials with sufficient insulating properties.

When the printhead 210 is to be connected to the substrate 224 of the printhead assembly, the substrate 224 is placed in an appropriate position so as to be in contact with the thin film resistor 212. In this embodiment, the substrate 224 is of an inorganic material which for purposes of this disclosure is considered to be ceramic. The inorganic material can comprise silicon, glass, ceramic, or a low thermal expansion metal but is not limited thereto. Once the substrate 224 and the silicon printhead 212 have been properly aligned, the first and second voltages are applied to the conductors of the thin film resistor 212 causing electrical current to flow through the resistor 212. The current flowing through the thin film resistor 212 provides localized heating to the substrate 224 so as to attach and seal the substrate 224 to the thin film resistor 212. In addition, mechanical pressure can be applied to both the printhead 210 and the substrate 224 during the heating and curing process to help seal the printhead 210 and substrate 224 together.

It will be understood by one skilled in the art that the thin film resistor 212 can alternatively be patterned on the substrate 224 rather than the printhead 210. In such an embodiment, when the voltages are applied to the thin film resistor 212, the thin film resistor 212 provides localized heating to the printhead 210 so as to attach and seal the printhead 210 to the thin film resistor 212. In addition, it will be understood that the thin film resistor can be thermally isolated from areas of the printhead and/or substrate by means of a thin film insulator (not shown).

Figure 3:
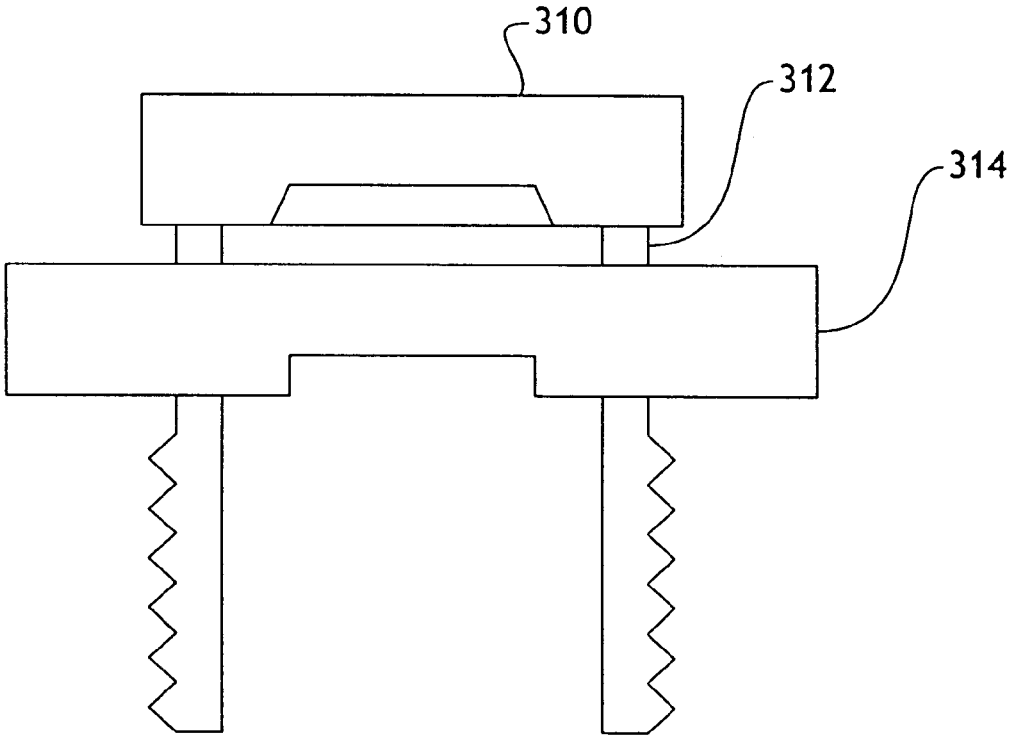
FIG. 3 illustrates using a thin film resistor to attach a printhead to a fluid interconnect device according to one embodiment of the invention.

It will also be understood that the printhead attachment can be to a substrate, fluid interconnect device or pen assembly, but the invention is not limited thereto. For example, the thin film resistor can be used to connect or "solder" the printhead to a fluid interconnect device as illustrated in FIG. 3. The thin film resistor 312 can be patterned onto either the bottom surface of the printhead 310 or a top surface of a fluid interconnect device 314. When the printhead 310 and the fluid interconnect device 314 are aligned in a desired position, the first and second voltages are applied to the thin film resistor 312. The localized heating of the thin film resistor 312 then causes the printhead 310 and the fluid interconnect device 314 to attach and seal to the thin film resistor 312 so long as the bottom surface of the printhead 310 and the top surface of the fluid interconnect device 314 have substantially similar coefficient of thermal expansion characteristics. Furthermore, the thin film resistor can be positioned so as to allow the printhead 310 to be in fluidic connection with the fluid interconnect device 314.

Figure 4:
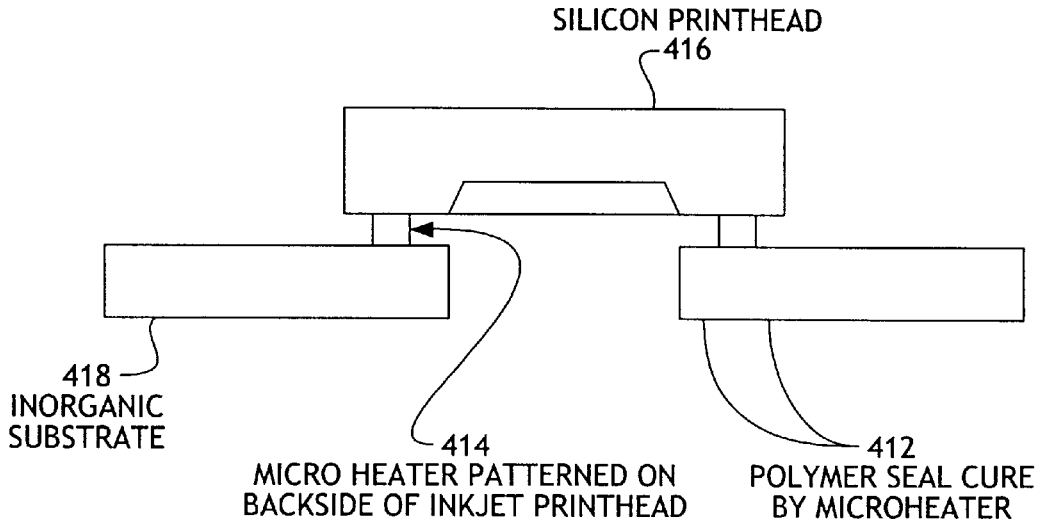
FIG. 4 illustrates using a thin film resistor and a temperature curable adhesive to attach a printhead to the printhead attachment according to one embodiment of the invention.
Figure 5:
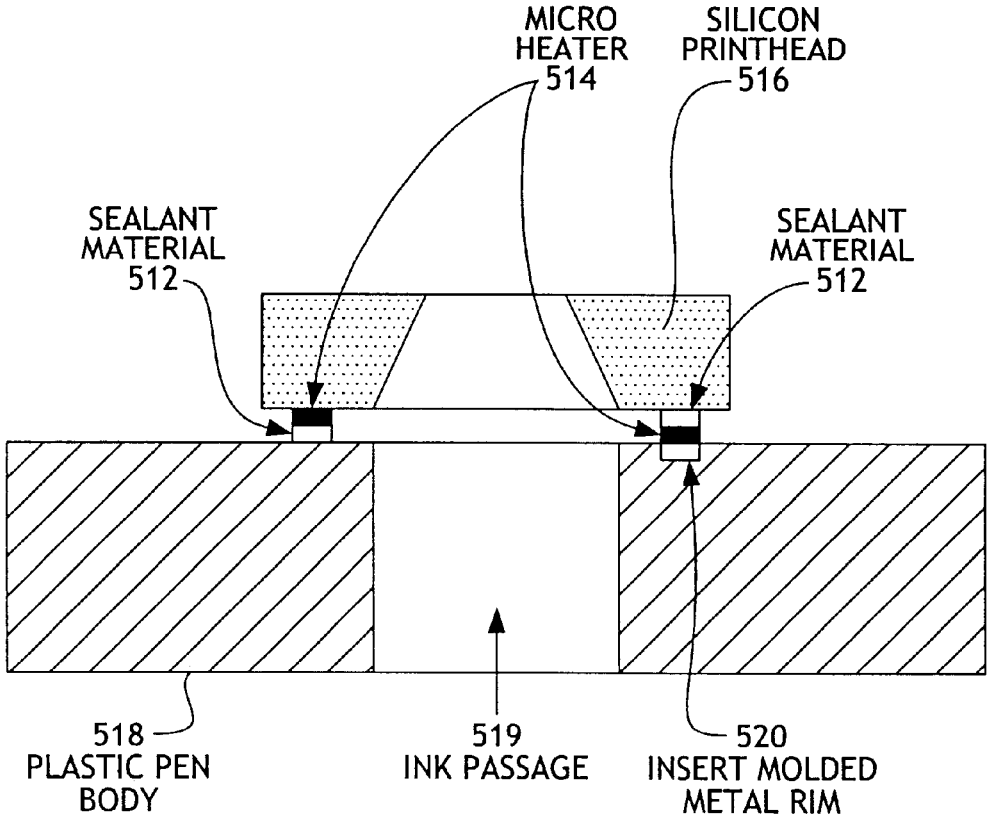
FIG. 5 illustrates using a thin film resistor and a seal material to attach a printhead to a pen assembly.

In another embodiment of the invention, the microheaters can be used in combination with a polymer seal material to attach the printhead to a substrate of a printhead assembly as illustrated in FIG. 4. In this embodiment, a temperature curable adhesive 412 can be patterned proximate to the thin film resistor 414 on the printhead 416 and/or the printhead attachment 418. When the first and second voltages are applied to the thin film resistor 414, the thin film resistor provides localized heating, which cures the adhesive 412. The curing of the adhesive 412 thereby attaches and seals the printhead 416 to the printhead attachment 418. It will be understood that the printhead attachment can be to a substrate, fluid interconnect device or pen assembly, but the invention is not limited thereto. For example, the printhead attachment can be a plastic pen assembly 518 with an insert molded metal rim 520 as illustrated in FIG. 5. In this example, a second shot seal material 512 can be patterned proximate to the thin film resistor 514 on the printhead 516 and/or the pen assembly 518 and/or the molded metal rim 520. When the first and second voltages are applied to the thin film resistor 514, the thin film resistor provides localized heating, which cures the seal material 512. The curing of the seal material 512 thereby attaches and seals the printhead 516 to the pen assembly 518 (molded metal rim 520).

Figure 6:
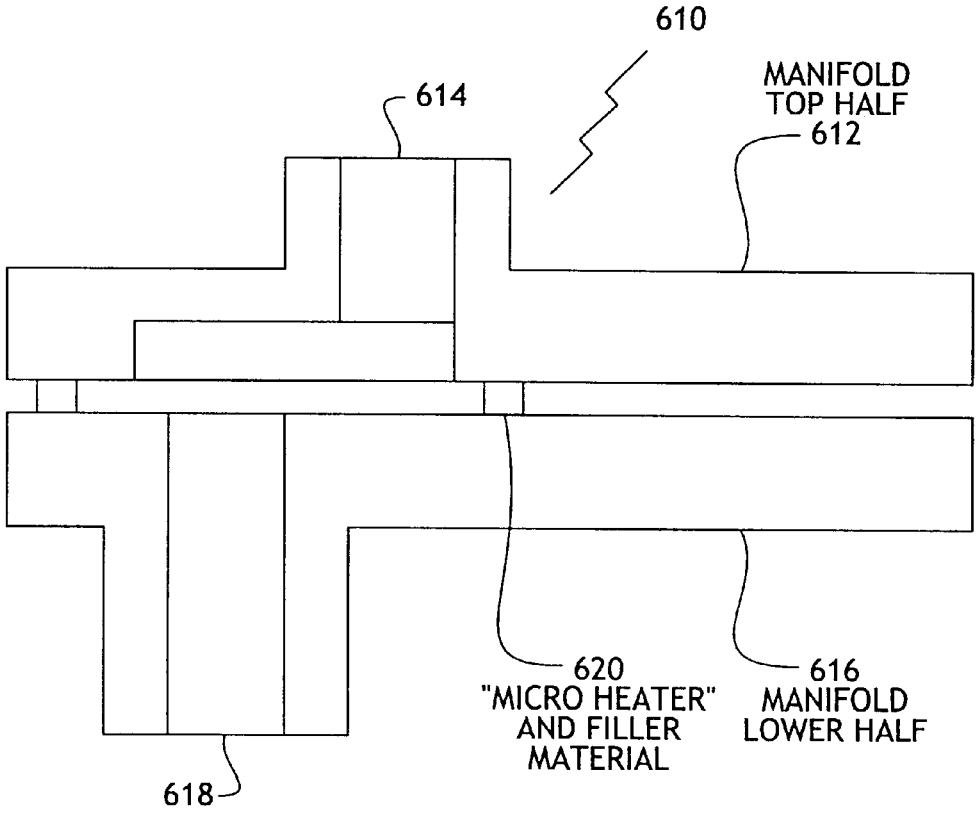
FIG. 6 illustrates using a thin film resistor to attach pieces of a manifold according to one embodiment of the invention.

According to another embodiment of the invention, thin film resistors can be used to assemble pieces required to make a manifold with internal passages for ink delivery as illustrated in FIG. 6. In the embodiment illustrated in FIG. 6, the manifold 610 has two halves: a top half 612 with a fluid passage 614, and a bottom half 616 with a fluid passage 618. A thin film resistor 620 can be patterned onto either the top half 612 or the bottom half 616 of the manifold 610. When the top half 612 and the bottom half 616 have been properly aligned so as to provide a fluid passage through the manifold, first and second voltages are applied to the thin film resistor 620 to provide localized heating. The heating causes the top half 612 and the bottom half 616 to attach and seal to the thin film resistor 620 so long as the surfaces of the two halves of the manifold in contact with the thin film resistor 620 have similar coefficient of thermal expansion characteristics. In addition, it will be understood that a temperature curable adhesive can be patterned proximate to the thin film resistor 620 to help secure the two halves of the manifold. Furthermore, a thin film insulator can be patterned proximate to the thin film resistor 620 to insulate portions of the two halves of the manifold from the heating effects of the thin film resistor 620.

In yet other embodiments of the invention, the microheater resistors can be used to reflow thermoplastic material from which a pen body, or parts thereof, are assembled. Thermoset polymers can also be cured as well. In yet other embodiments, solder or brazing material can be heated to reflow as well.

For purposes of claim construction, thermoplastic and thermoset materials, solder and brazing materials are considered to be equivalent temperature-curable adhesives. When such temperature-curable adhesives are disposed proximate to the aforementioned microheaters, localized temperature-sensitive curing of adhesives used in the assembly of a variety of structures such as substrates or even compete pen devices is enabled.

While the present invention has been particularly shown and described with reference to particular embodiments thereof, it will be understood by those skilled in the art that various changes in form and details may be made therein without departing from the spirit and scope of the present invention.

We claim:

1. An apparatus for assembling an inkjet printhead comprising:

an ink jet printhead;

a substrate to which said ink jet printhead is to be attached;

a microheater, coupled to at least one of said ink jet printhead and said substrate, said microheater comprising:

a heater resistor comprising an input port and an output port;

a first electrical conductor, coupled to the input port of the heater resistor, for receiving a first voltage;

a second electrical conductor, coupled to the output port of the heater resistor, for receiving a second voltage;

a temperature curable adhesive disposed proximate to the heater resistor and at least one of said ink jet printhead and said substrate;

wherein a curing effect in the adhesive is produced by an application of a first voltage to the first electrical conductor and a second voltage to the second electrical conductor.

2. The apparatus of claim 1, wherein the second voltage comprises a circuit ground.

3. The apparatus of claim 2, further comprising a switching device coupled between the circuit ground and the second electrical conductors.

4. The apparatus of claim 1, wherein the heater resistor comprises a resistive film deposited on a substrate.

5. The apparatus of claim 1, further comprising an isolation layer that is deposited on the resistive film, wherein the temperature curable adhesive is deposited on the isolation layer and the isolation layer provides isolation between the resistive film and the temperature curable adhesive.

6. The apparatus of claim 1, wherein the heater resistor and the temperature curable adhesive form a seal.

7. An inkjet printer cartridge, comprising:

a printhead made of silicon and comprising a top side and a bottom side, the bottom side having a microheater comprising:

a heater resistor comprising an input port and an output port;

a first electrical conductor, coupled to the input port of the heater resistor, for receiving a first voltage;

a second electrical conductor, coupled to the output port of the heater resistor, for receiving a second voltage;

a printhead attachment disposed below the bottom side of the printhead, wherein the printhead attachment is affixed to the printhead by an application of a first voltage to the first electrical conductor and a second voltage to the second electrical conductor;

and wherein the printhead attachment has a surface with a substrate of an inorganic material which has similar coefficient of thermal expansion characteristics as the silicon printhead.

8. The inkjet printer cartridge of claim 7, wherein the inorganic material is one of: silicon; glass; ceramic; low thermal expansion metal.

9. An inkjet printer cartridge, comprising:

a printhead comprising a top side and a bottom side;

a substrate disposed below the bottom side of the printhead and having a microheater comprising:

a heater resistor comprising an input port and an output port;

a first electrical conductor, coupled to the input port of the heater resistor, for receiving a first voltage;

a second electrical conductor, coupled to the output port of the heater resistor, for receiving a second voltage; and a temperature curable adhesive disposed between the printhead and the substrate and further disposed proximate to the heater resistor, wherein the printhead is affixed to the substrate by an application of a first voltage to the first electrical conductor and a second voltage is applied to the second electrical conductor.

10. The inkjet printer cartridge of claim 9, wherein the temperature curable adhesive is applied to the substrate.

11. The inkjet printer cartridge of claim 9, wherein the temperature curable adhesive is applied to the bottom side of the printhead.

12. The inkjet printer cartridge of claim 9, wherein the second voltage comprises a circuit ground.

13. A method for assembling an inkjet printhead assembly comprising the steps of:

patterning a heater resistor onto a bottom surface of a printhead;

aligning a printhead attachment in a desired position wherein a surface of the printhead attachment is in contact with the heater resistor;

applying a voltage drop across a heater resistor;

producing an electrical current in the heater resistor in response to the application of the voltage drop; and generating a temperature increase in the heater resistor and an area proximate to the heater resistor in response to the production of an electrical current thereby causing the printhead and printhead attachment to attach to the heater resistor.

14. The method of claim 13, further comprising the step of patterning a temperature curable adhesive proximate to the heater resistor, wherein the adhesive cures in response to the temperature increase of the heater resistor thereby attaching the printhead to the printhead attachment.

15. The method of claim 13, further comprising the step of patterning a thin film insulator on at least one portion of the printhead and printhead attachment to insulate portions of the printhead and printhead attachment from the temperature increase of the heater resistor.

16. A method for assembling an inkjet printhead assembly comprising the steps of:

patterning a heater resistor onto a surface of a printhead attachment;

aligning a printhead in a desired position wherein a surface of the printhead is in contact with the heater resistor;

applying a voltage drop across a heater resistor;

producing an electrical current in the heater resistor in response to the application of the voltage drop; and generating a temperature increase in the heater resistor and an area proximate to the heater resistor in response to the production of an electrical current thereby causing the printhead and printhead attachment to attach to the heater resistor.

17. The method of claim 16, further comprising the step of patterning a temperature curable adhesive proximate to the heater resistor, wherein the adhesive cures in response to the temperature increase of the heater resistor thereby attaching the printhead to the printhead attachment.

18. The method of claim 16, further comprising the step of patterning a thin film insulator on at least one portion of the printhead and printhead attachment to insulate portions of the printhead and printhead attachment from the temperature increase of the heater resistor.

19. A method for attaching pieces of a manifold using localized heating, comprising the steps of:

patterning a thin film resistor onto a surface of a first half of a manifold with a first fluid passage, aligning a second half of the manifold with a second fluid passage so as to provide a third fluid passage through the manifold, wherein a surface of the second half of the manifold is in contact with the thin film resistor;

applying a voltage drop across the thin film resistor to produce an electrical current in the thin film resistor;

generating a temperature increase in the thin film resistor and an area proximate to the thin film resistor in response to the production of the electrical current;

curing at least portions of the first half and the second half of the manifold proximate to the thin film resistor thereby attaching and sealing the first half and the second half of the manifold to the thin film resistor.

20. The method of claim 19, further comprising the step of patterning a temperature curable adhesive proximate to the thin film resistor, wherein the adhesive cures in response to the temperature increase of the thin film resistor thereby attaching the first half and the second half of the manifold.

21. The method of claim 19, further comprising the step of patterning a thin film insulator on at least one portion of the first half and second half of the manifold to insulate portions of the printhead and printhead attachment from the temperature increase of the thin film resistor.

* * * * *

UNITED STATES PATENT AND TRADEMARK OFFICE

CERTIFICATE OF CORRECTION

PATENT NO. : 6,460,966 B1
DATED : October 8, 2002
INVENTOR(S) : Hellekson et al.

It is certified that error appears in the above-identified patent and that said Letters Patent is hereby corrected as shown below:

Column 7,
Line 22, delete "conductors." and insert therefor -- conductor. --.

Signed and Sealed this

Sixteenth Day of December, 2003

JAMES E. ROGAN
*Director of the United States Patent and Trademark Office*